US007673706B2

(12) United States Patent
Simmons

(10) Patent No.: US 7,673,706 B2
(45) Date of Patent: Mar. 9, 2010

(54) DOWN-THE-HOLE HAMMER WITH PILOT AND METHOD OF ENLARGING A HOLE

(75) Inventor: Rob A. Simmons, Arlington, TX (US)

(73) Assignee: Sandvik Intellectual Property AB, Sandviken (SE)

( * ) Notice: Subject to any disclaimer, the term of this patent is extended or adjusted under 35 U.S.C. 154(b) by 188 days.

(21) Appl. No.: 11/278,013

(22) Filed: Mar. 30, 2006

(65) Prior Publication Data

US 2007/0227777 A1 Oct. 4, 2007

(51) Int. Cl.
*E21B 7/28* (2006.01)
*E21B 10/40* (2006.01)

(52) U.S. Cl. ..... 175/57; 175/389; 175/407; 175/414

(58) Field of Classification Search ..... 166/57, 166/389, 390, 407, 414
See application file for complete search history.

(56) References Cited

U.S. PATENT DOCUMENTS

| | | | | | |
|---|---|---|---|---|---|
| 2,053,801 | A | | 9/1936 | Mitchell | 175/405.1 |
| 2,262,001 | A | | 11/1941 | Hokanson | 175/390 |
| 2,659,577 | A | * | 11/1953 | Watson | 175/387 |
| 2,884,227 | A | * | 4/1959 | Hjalsten | 175/435 |
| 3,028,772 | A | * | 4/1962 | Mossberg | 408/59 |
| 3,145,789 | A | * | 8/1964 | Lawry | 175/386 |
| 3,190,378 | A | | 6/1965 | Davey, Sr., et al. | 175/257 |
| 3,382,940 | A | * | 5/1968 | Stebley | 175/426 |
| 3,463,252 | A | * | 8/1969 | Garrett et. al. | 175/27 |
| 3,469,641 | A | * | 9/1969 | Reynolds | 175/389 |
| 3,870,114 | A | | 3/1975 | Pulk et al. | 175/258 |
| 4,043,136 | A | | 8/1977 | Cherrington | 405/161 |
| 4,117,895 | A | | 10/1978 | Ward et al. | 175/53 |
| 4,275,796 | A | * | 6/1981 | Kleine | 175/385 |
| 4,574,895 | A | * | 3/1986 | Dolezal et al. | 175/429 |
| 4,842,081 | A | | 6/1989 | Parant | 173/186 |
| 4,844,186 | A | * | 7/1989 | Beecroft | 175/414 |
| 4,932,129 | A | * | 6/1990 | Schellstede et al. | 30/358 |
| 5,284,216 | A | * | 2/1994 | Brungs et al. | 175/385 |
| 5,472,057 | A | | 12/1995 | Winfree | 175/57 |
| 5,791,419 | A | | 8/1998 | Valisalo | 175/53 |
| 5,934,394 | A | * | 8/1999 | Fareham | 175/292 |

(Continued)

FOREIGN PATENT DOCUMENTS

WO 95/22677 A1 8/1995

(Continued)

OTHER PUBLICATIONS

International Search Report and Written Opinion for International Application PCT/SE2007/000103, Gutaiou, Lema, Nov. 5, 2007.*

(Continued)

*Primary Examiner*—David J Bagnell
*Assistant Examiner*—David Andrews
(74) *Attorney, Agent, or Firm*—WRB-IP LLP

(57) ABSTRACT

A down-the-hole hammer includes a piston movably disposed in a casing and a percussion bit at an end of the casing. The percussion bit includes an integral bit and shank and a pilot removably fastened at a forward end of the bit. A method of enlarging a preexisting hole is also provided.

27 Claims, 6 Drawing Sheets

U.S. PATENT DOCUMENTS

| | | | | |
|---|---|---|---|---|
| 5,957,224 | A | 9/1999 | Ilomaki | 175/57 |
| 5,975,222 | A * | 11/1999 | Holte | 175/273 |
| 6,202,768 | B1 * | 3/2001 | Lindgren et al. | 175/389 |
| 6,808,030 | B2 | 10/2004 | Klemm | 175/53 |
| 2005/0072602 | A1 * | 4/2005 | Pascale et al. | 175/414 |

FOREIGN PATENT DOCUMENTS

| | | | |
|---|---|---|---|
| WO | WO 95/22677 | * | 8/1995 |
| WO | 03/001022 | A1 | 1/2003 |
| WO | WO 03/01022 | A1 * | 1/2003 |

OTHER PUBLICATIONS

International Search Report and Written Opinion for corresponding International Application PCT/SE2007/000103.

* cited by examiner

DOWN-THE-HOLE HAMMER WITH PILOT AND METHOD OF ENLARGING A HOLE

The present invention relates to a down-the-hole hammer with a pilot and a method of enlarging a hole.

In situations in which it is desired to enlarge a preexisting hole by forming an enlarged hole along the axis of the preexisting hole or substantially along its axis—such as in so-called "reaming" operations—a percussion bit 1 having a pilot portion 2 as seen in FIG. 6 can be used together with a piston and casing of a percussion hammer (not shown). The percussion bit 1 and pilot 2 are manufactured as a single unit from a solid bar. The pilot 2 is received in a preexisting hole and guides the bit 1 relative to the hole so that, within limits largely depending upon the clearance between the pilot and the walls of the preexisting hole, the enlarged hole will be substantially coaxial with the preexisting hole. Flushing medium such as compressed air, water, or slurry, is introduced to the face of the bit 3 of the percussion bit 1 through an axial passage 4 through the shank 5 of the percussion bit, and through substantially radial passages 6 near the face of the bit. The flushing medium flows out of the radial passages 6 and then returns through recesses 7 provided in the bit 3 and between the walls of the enlarged hole and the casing (not shown) of the hammer.

It is desirable to provide a down-the-hole hammer with a percussion bit and pilot that is simple and inexpensive to manufacture and repair. It is also desirable to improve energy transmission between a cutting face of a percussion bit and the rock in a down-the-hole hammer.

In accordance with an aspect of the present invention, a down-the-hole hammer includes a piston movably disposed in a casing and a percussion bit at an end of the casing, the percussion bit comprising an integral bit and shank and a pilot removably fastened at a forward end of the bit.

In accordance with another aspect of the present invention, a percussion bit assembly comprises an integral bit and shank and a pilot removably fastened at a forward end of the bit.

In accordance with still another aspect of the present invention, a method of enlarging a preexisting hole is provided. According to the method, a down-the-hole hammer having a percussion bit comprising an integral bit and shank and a pilot removably fastened at a forward end of the bit is positioned relative to the preexisting hole such that the pilot is disposed in the preexisting hole. The down-the-hole hammer is operated such that the bit of the percussion bit forms an enlarged hole while the pilot steers the bit relative to the preexisting hole.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1:
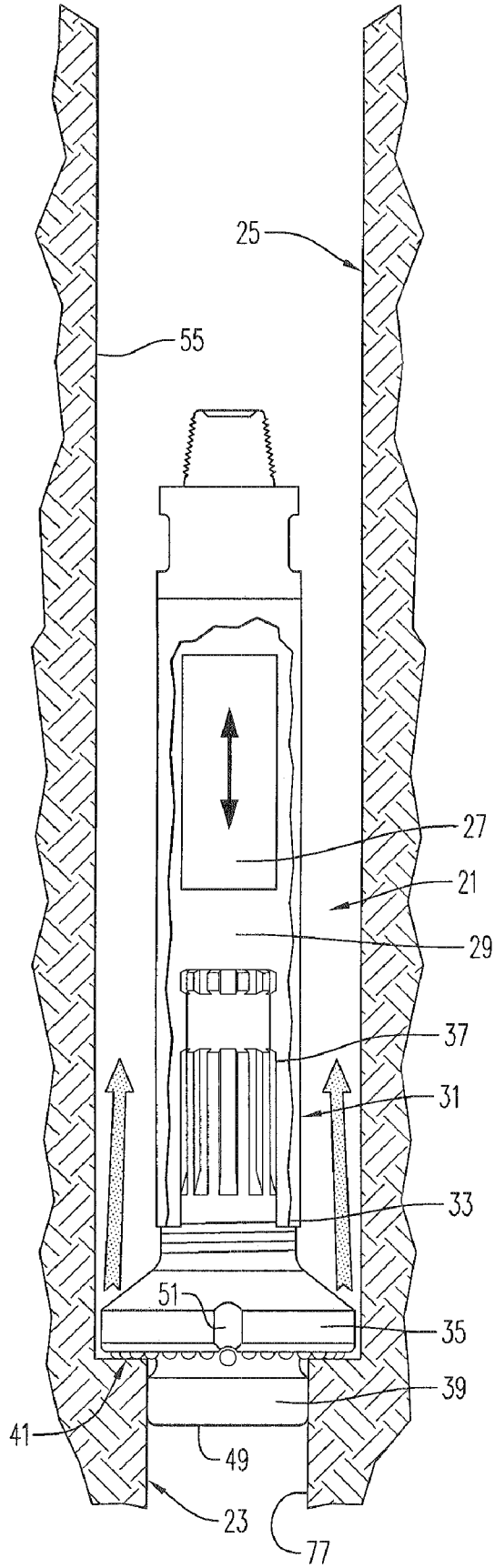
FIG. 1 is a partially cross-sectional view of a down-the-hole hammer enlarging a preexisting hole according to an embodiment of the present invention.

A down-the-hole hammer 21 according to an embodiment of the present invention is shown in FIG. 1. The hammer 21 is adapted to enlarge a preexisting hole 23, thereby forming an enlarged hole 25.

The hammer 21 can be, in most respects, a conventional hammer of the type comprising a piston 27 movably disposed in a cylinder or casing 29. Illustrative of such hammers are the Driltech Mission DTH (down-the-hole) hammers available from the Driltech Mission group of Sandvik Mining and Construction, 1300 Heritage Pkwy, Mansfield, Tex. 76063. The hammer 21 further comprises a percussion bit 31 at an end 33 of the casing 29. The percussion bit 31 is of a conventional type comprising an integral bit 35 and shank 37.

Figure 2A:
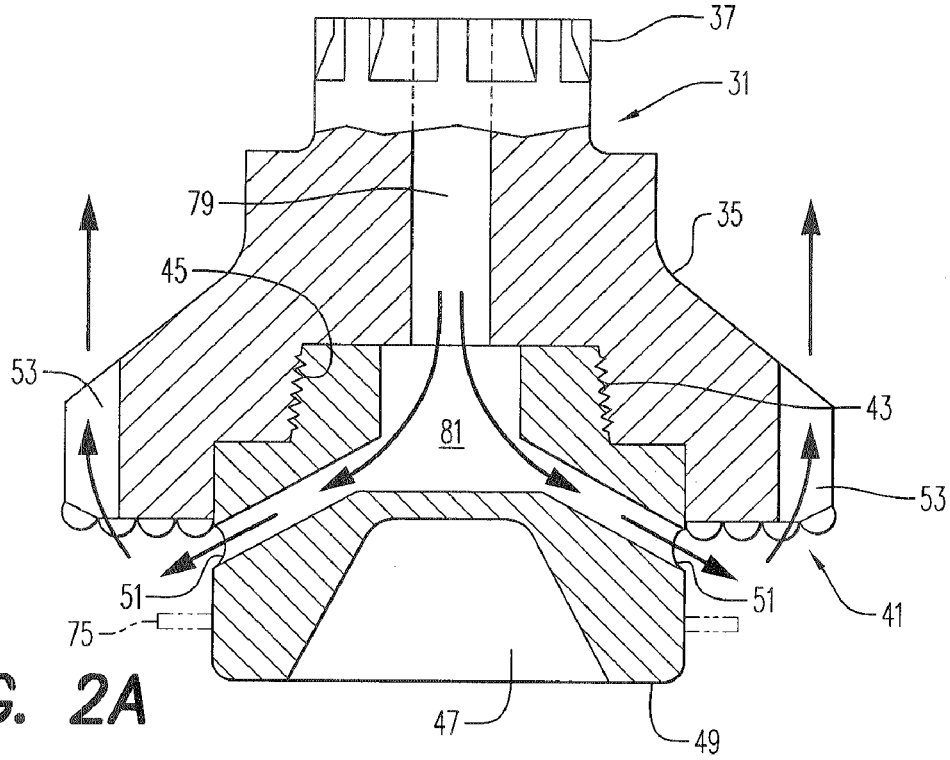
FIG. 2A is a cross-sectional view of part of and FIG. 2B is an end view of a percussion bit with a pilot according to an embodiment of the present invention.
Figure 3A:
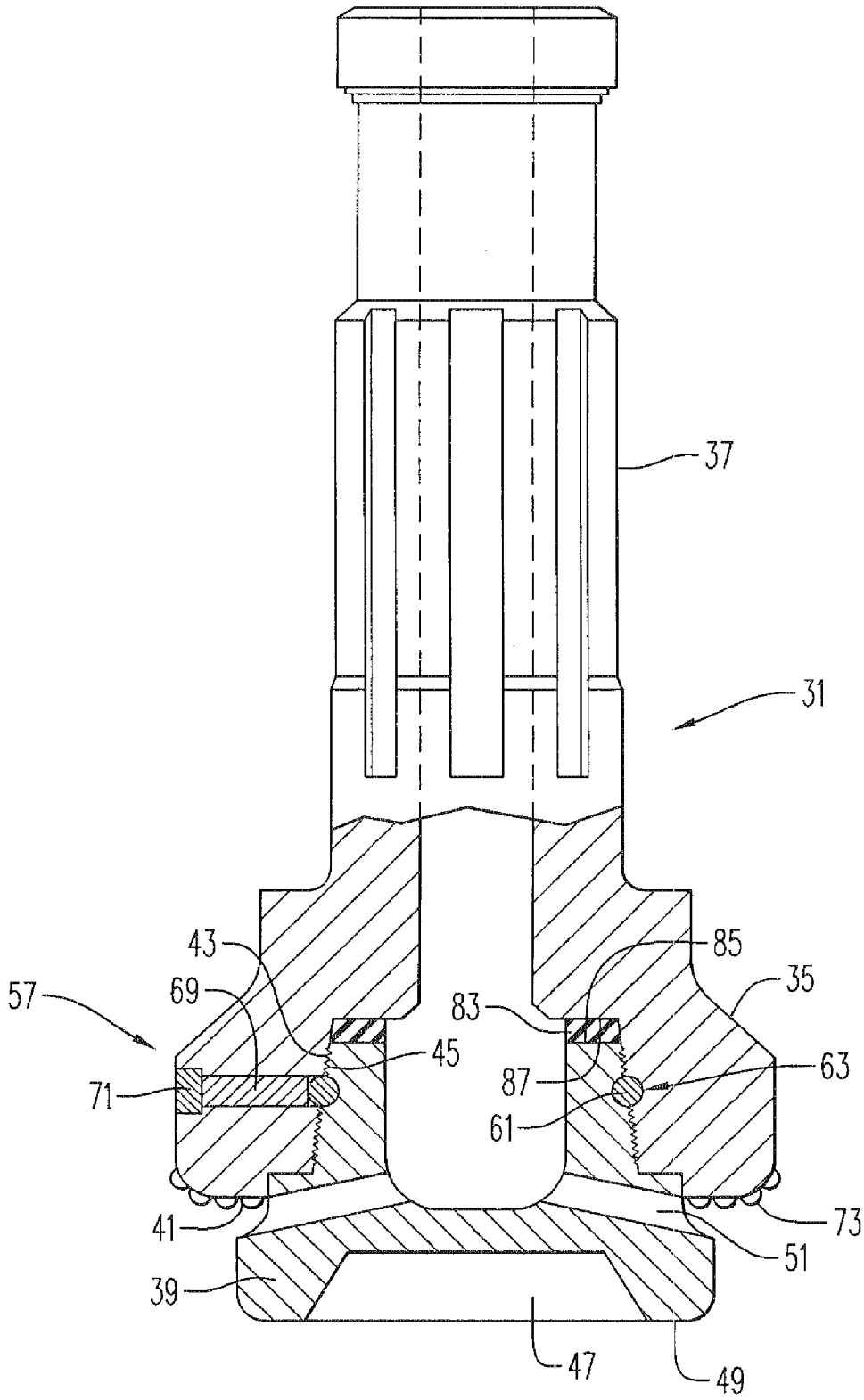
FIG. 3A is a partially cross-sectional view of a percussion bit with a pilot according to an embodiment of the present invention.
Figure 3B:
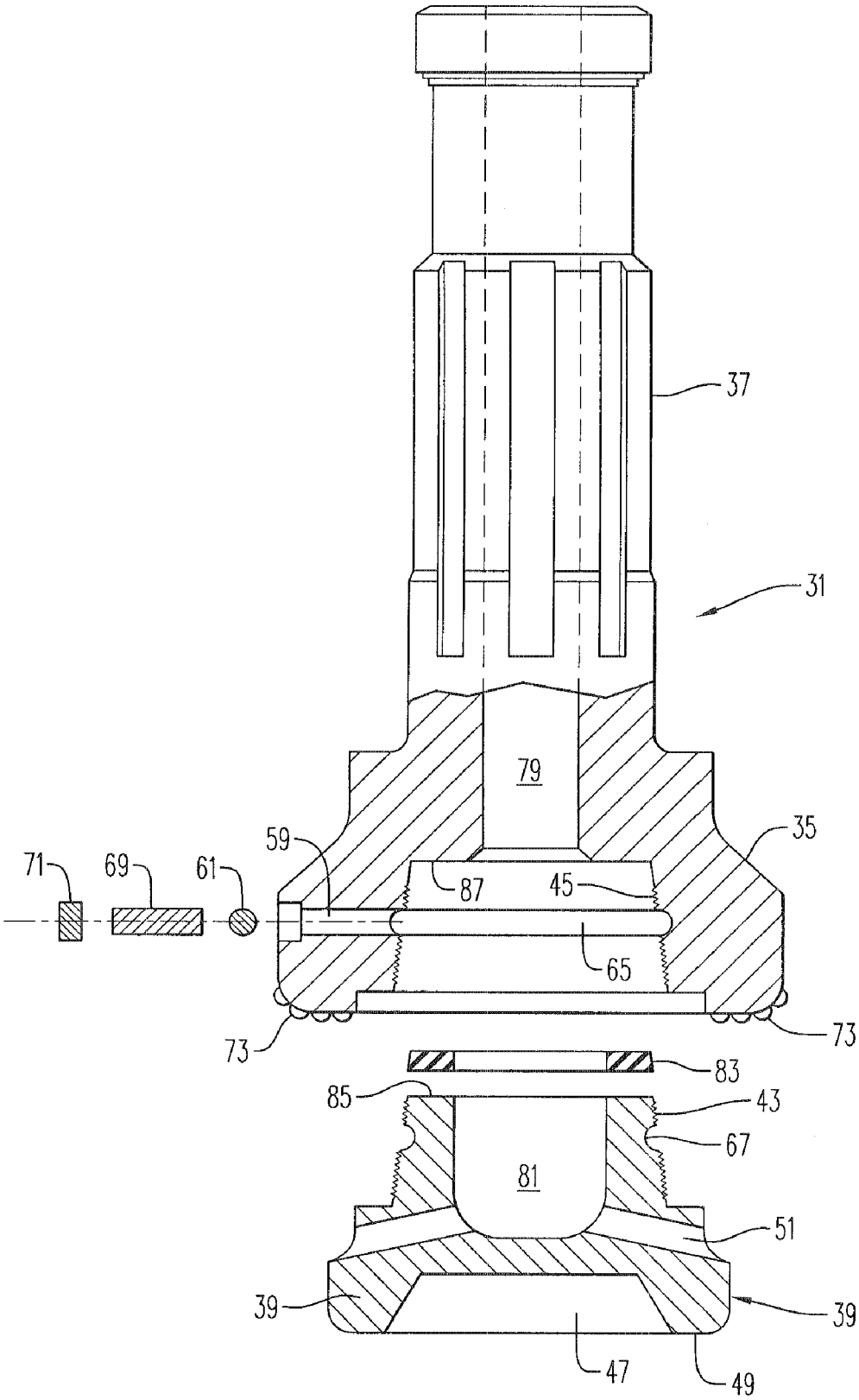
FIG. 3B is a partially cross-sectional, exploded view of the percussion bit with a pilot of FIG. 3A.
Figure 4:
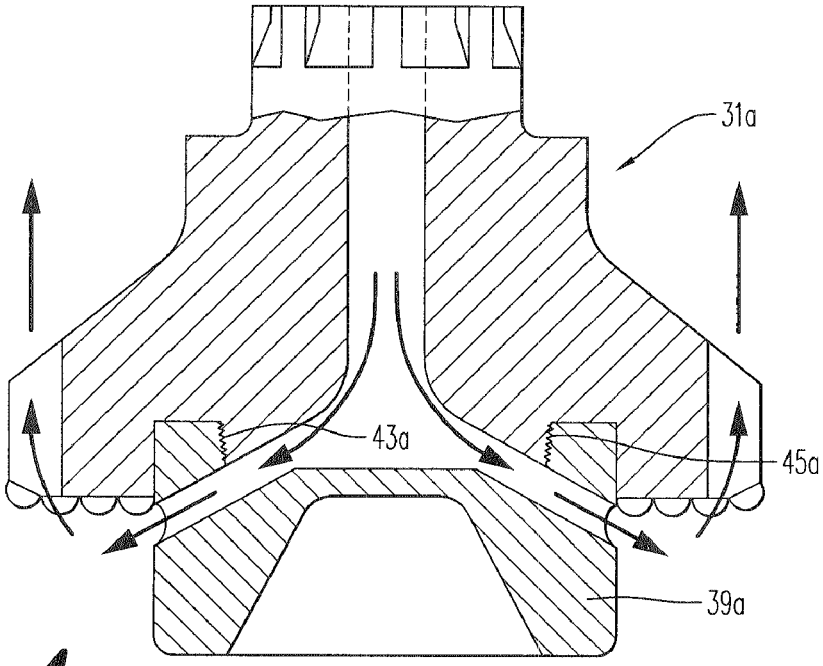
FIG. 4 is a cross-sectional view of part of a percussion bit with a pilot according to another embodiment of the present invention.
Figure 6:
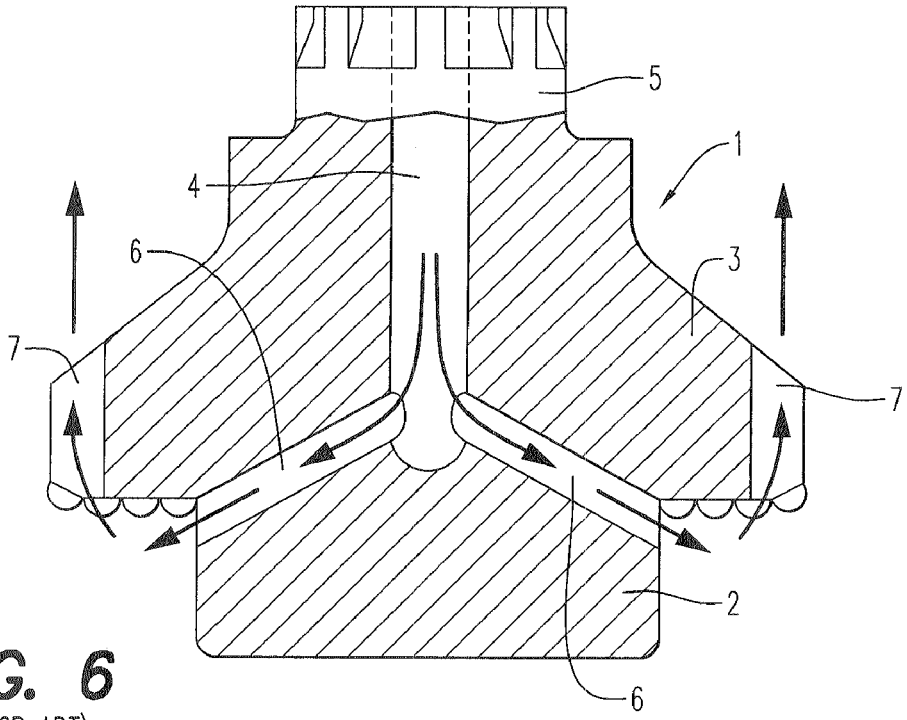
FIG. 6 (PRIOR ART)
FIG. 6 is a cross-sectional view of a percussion bit according to the prior art.

The percussion bit 31 further comprises a pilot 39 removably fastened at a forward end 41 of the bit 35. As seen in FIGS. 2A and 3A-3B, the pilot 39 can include a male threaded portion 43 and the percussion bit 31 can include a female threaded portion 45 with which the male threaded portion is adapted to mate to removably fasten the pilot at the forward end 41 of the bit 35. Alternatively, as seen in FIG. 4, the pilot 39*a* can include a female threaded portion 43*a* and the percussion bit 31*a* can include a female threaded portion 45*a* with which the male threaded portion is adapted to mate to removably fasten the pilot at the forward end 41 of the bit 35. It will be appreciated that the precise form of the threaded connections need not be as illustrated in FIGS. 2A, 3A-3B, or 4. For purposes of illustration, embodiments including male threaded portions 43 on the pilot 39 and female threaded portions 45 on the percussion bit 31 will be discussed, it being understood that the discussion is equally applicable to embodiments with female threaded portions on the pilot and male threaded portions on the percussion bit, except where otherwise indicated.

Figure 5:
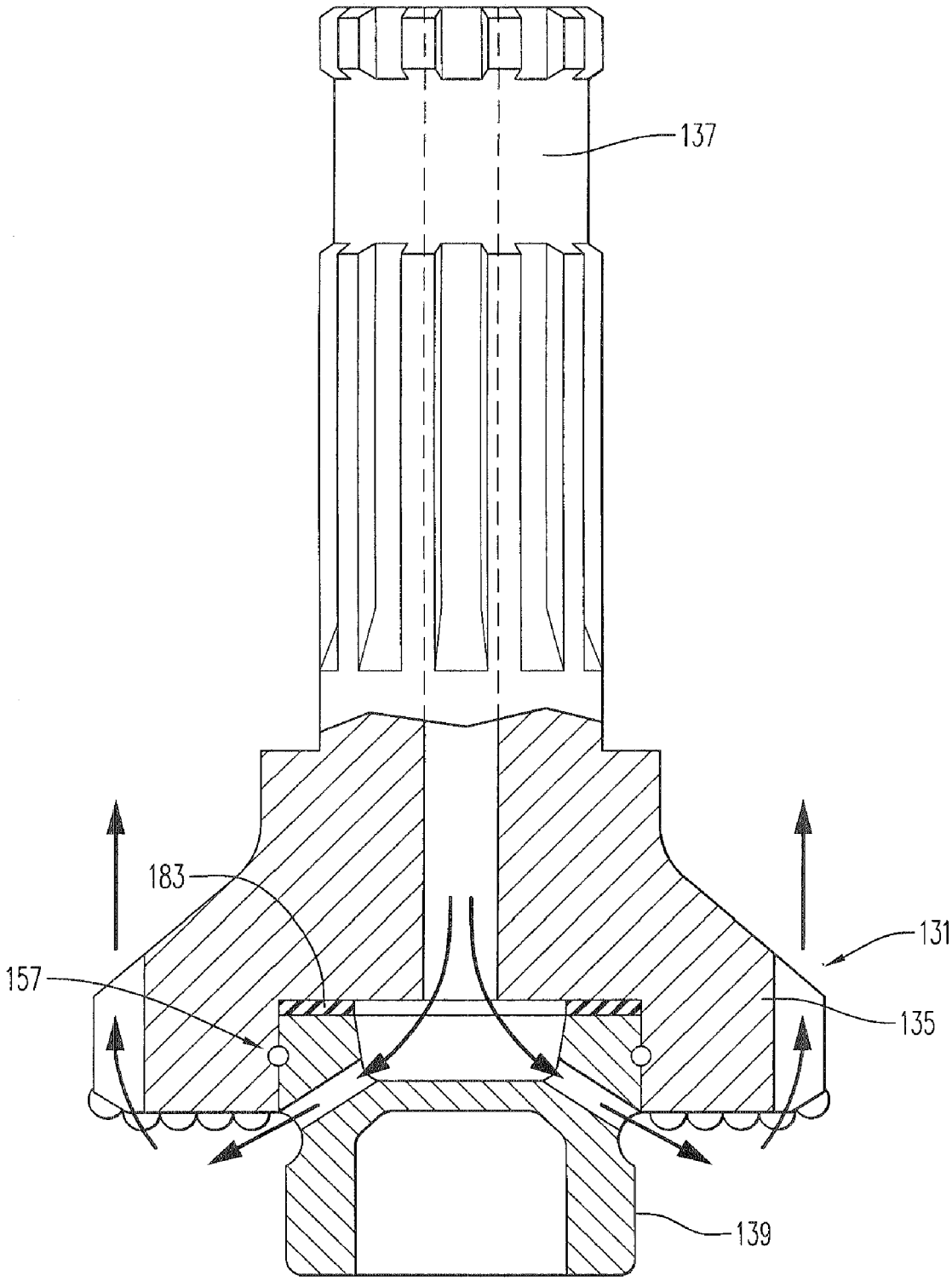
FIG. 5 is a cross-sectional view of part of a percussion bit with a pilot according to another embodiment of the present invention.

The pilot 39 may be made of a material that is lighter and/or less expensive than the material from which the percussion bit 31 is made. For example, the percussion bit 31 will often be made of a high quality alloy steel, while the pilot 39 may be made of a commercial grade carbon steel such as 1018 or 1050, which will ordinarily be less expensive than the alloy. The pilot 39 can have a portion that has less mass per unit volume than another portion. For example, the pilot 39 can include a hollow portion, such as by forming a recess 47 in the forward end 49 of the pilot. The recess 47 is recessed relative to the front end of the pilot over an entire diameter of the pilot and the diameter of the opening of the recess is greater than one half of a diameter of the pilot. Other possible arrangements include, instead of providing a hollow portion, providing interior material of the pilot that is less dense than exterior material, or providing recesses or through-holes in the pilot. By reducing the mass of the pilot 39, more energy of the piston 27 can be transmitted to the bit 35 instead of being absorbed by the mass of a one-piece configuration, such as is shown in FIG. 5. In addition, by reducing the mass of the pilot 39, the combination of the percussion bit 31 with the pilot 39 may have a lower mass and use less material relative to similar structures formed from a single steel bar. Further, manufacturing of the percussion bit 31 separately from the pilot 39 can be simpler than manufacturing of a percussion bit formed with a pilot from a solid steel bar.

Figure 2B:
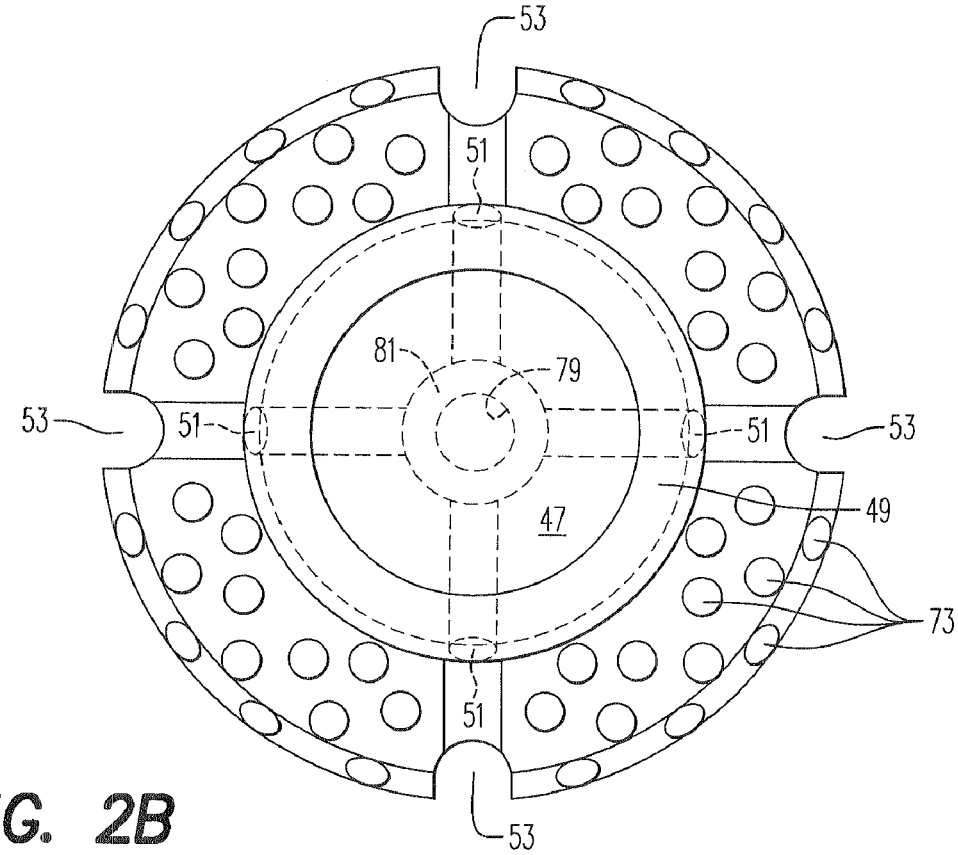

The pilot 39 can include at least one flushing medium hole 51 extending at an angle to a longitudinal axis of the pilot. Ordinarily, a plurality of flushing medium holes 51 are provided, such as is shown in FIG. 2B where four flushing medium holes are provided. The flushing medium can be compressed air or any other suitable medium. The flushing medium passes forwardly to the front end of the bit 35, substantially radially through the flushing medium holes 51, and rearwardly through recesses 53 provided in the bit and between the casing 29 and walls 55 of the enlarged hole 25.

As seen in FIGS. 3A-3B, a pin assembly 57 can be disposed in an opening 59 in the percussion bit 31 for removably fastening the pilot 39 relative to the percussion bit. The pin assembly 57 can be an additional means of removably fastening the pilot 39 to the percussion bit 31 together with threaded connections, or an alternative means. The pin assembly 57 can include one or more ball bearings 61 adapted to pass through the opening 59 in the percussion bit 31 and adapted to be received in a channel 63 formed by aligned grooves 65 and 67 in the percussion bit and the pilot 39, respectively. Upon positioning the one or more ball bearings 61 in the channel 63, a pin 69 can be positioned in the opening 59 in the percussion bit 31 and the opening in the percussion bit can be capped with a wear button 71, such as a cemented carbide wear button.

A shock absorbing arrangement for absorbing shocks that might be transmitted to or from the percussion bit 31 to the pilot 39 can be provided. As seen in FIGS. 3A and 3B, the shock absorbing arrangement may comprise any suitable arrangement, such as a resilient member 83 such as a spring or a rubber spacer between facing portions of the percussion bit 31 and the pilot 39, such as between a top end 85 of the pilot 39 and a facing bottom end 87 of the percussion bit 31. The shock absorbing arrangement may be used with the pin assembly 57, with the threaded connection 43, 45, or with the pin assembly together with the threaded connection.

The opening 59 may be internally threaded and the pin 69 and/or the wear button 71 may be externally threaded, although it will be appreciated that the pin and wear button may be held in the opening in other ways, such as by a friction fit between the wear button and the opening. It will further be appreciated that other forms of pin assemblies, such as pins received in aligned openings in the percussion bit 31 and the pilot 39, will also be suitable, and that other backup fastening arrangements, or no backup fastening arrangements, can also be used.

The bit 35 typically comprises a plurality of rock cutting members 73 disposed thereon. The pilot 39 will ordinarily have no rock cutting members and will function entirely as a guide for the bit 35, however, the pilot may be provided with rock cutting members, such as may be desirable if obstructions in the preexisting hole are likely to be encountered.

As seen in FIG. 5, a threaded connection may be omitted entirely and a percussion bit 131 can include a pilot 139 secured relative to an integral bit 135 and shank 137 by a structure such as a pin assembly 157 that can be the same as the pin assembly 57. A resilient member such as a urethane spacer 183 can be provided between facing surfaces of the pilot 139 and the integral bit 135 and shank 137.

In a method of enlarging a preexisting hole 23 according to the present invention, the down-the-hole hammer 21 is positioned relative to the preexisting hole such that the pilot 39 is disposed in the preexisting hole. The down-the-hole hammer 21 is operated such that the bit 35 of the percussion bit 31 forms the enlarged hole 25 while the pilot 39 steers the bit relative to the preexisting hole. By selecting a pilot 39 having a diameter nearly as large as the diameter of the preexisting hole 23, the enlarged hole 25 can have substantially the same axis as the preexisting hole.

Of course, any desired clearance between the pilot 39 and the preexisting hole 23 can be provided, and the pilot will guide the cutting by the bit 35 generally along the axis of the preexisting hole with deviation permitted to an extent determined by the clearance. If the pilot 39 is sufficiently smaller than the preexisting hole 23, a packing part 75 (shown in phantom in FIG. 2A) may be provided on the pilot in the space between the pilot and walls 77 of the preexisting hole. The packing part 75 may, for example, be a flexible rubber skirt member such as is disclosed in WO 95/22677, which is incorporated by reference. The packing part 75 may be useful, for example, to assist in guiding the bit 35 as an extension of the pilot 39, and/or as a means of preventing flushing medium from flowing down the preexisting hole 23 instead of back between the casing 29 and the walls 55 of the enlarged hole 25. Flushing medium such as air, water, or a slurry will ordinarily be directed forward through an interior passage 79 through the percussion bit 31 to the forward end 41 of the bit 35 and rearwardly through the enlarged hole 25. An interior passage 81 leading to the openings 51 may also be provided in the pilot 39. The interior passage 81 can facilitate reducing the mass of the pilot 39 which can facilitate improving the amount of piston energy that is transferred through the face of the bit 35 instead of being absorbed by the pilot.

The flushing medium will ordinarily be directed to the forward end 41 of the bit 35 through at least one opening 51 in the pilot 39. Holes for introducing flushing medium may be provided in the percussion bit 31 above the pilot 39, however, it is anticipated that introducing the flushing medium at a point below the face of the bit 35 will facilitate clearing debris from the bit face. Ordinarily, the bit 35 (and rock cutting members 73 thereon) will perform all the cutting action for enlarging the preexisting hole 23. However, it will be appreciated that the pilot 39 can include some rock cutting members (not shown), particularly to facilitate clearing debris in the preexisting hole.

In the present application, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

While this invention has been illustrated and described in accordance with a preferred embodiment, it is recognized that variations and changes may be made therein without departing from the invention as set forth in the claims.

What is claimed is:

1. A down-the-hole hammer, comprising:

a piston, movably disposed in a casing; and a percussion bit at an end of the casing, the percussion bit comprising a monolithic bit and shank, the shank having a percussion surface for being contacted by a piston, and a monolithic pilot removably fastened directly to a forward end of the bit, wherein the pilot includes a recess with a circular opening extending into the pilot from a front end of the pilot so that at least first portion of the pilot including the recess has less mass per unit volume than a second portion of the pilot, the recess being recessed relative to the front end of the pilot over an entire diameter of the recess, the diameter of the recess opening being greater than one half of a diameter of the pilot.

2. The down-the-hole hammer as set forth in claim 1, wherein the pilot includes a male threaded portion and the percussion bit includes a female threaded portion with which the male threaded portion is adapted to mate to fasten the pilot at the forward end of the bit.

3. The down-the-hole hammer as set forth in claim 1, wherein the pilot includes at least one flushing medium hole extending at an angle to a longitudinal axis of the pilot.

4. The down-the-hole hammer as set forth in claim 1, comprising a pin assembly disposed in an opening in the percussion bit for locking the pilot relative to the percussion bit.

5. The down-the-hole hammer as set forth in claim 1, wherein the pilot includes a female threaded portion and the percussion bit includes a male threaded portion with which the female threaded portion is adapted to mate to fasten the pilot at the forward end of the bit.

6. The down-the-hole hammer as set forth in claim 1, wherein the bit comprises a plurality of rock cutting members disposed thereon.

7. The down-the-hole hammer as set forth in claim 6, wherein the pilot comprises no rock cutting members.

8. The down-the-hole hammer as set forth in claim 1, comprising a shock absorber between the pilot and the bit and shank.

9. The down-the-hole hammer as set forth in claim 1, wherein the pilot is made from different material than the bit and shank.

10. A percussion bit assembly comprising a monolithic bit and shank, the shank having a percussion surface for being contacted by a piston, and a monolithic pilot removably fastened directly to a forward end of the bit, wherein the pilot includes a recess with a circular opening extending into the pilot from a front end of the pilot so that at least a first portion of the pilot including the recess has less mass per unit volume than a second portion of the pilot, the recess being recessed relative to the front end of the pilot over an entire diameter of the recess, the diameter of the recess opening being greater than one half of a diameter of the pilot.

11. The percussion bit assembly as set forth in claim 10, wherein the pilot includes a male threaded portion and the percussion bit includes a female threaded portion with which the male threaded portion is adapted to mate to fasten the pilot at the forward end of the bit.

12. The percussion bit assembly as set forth in claim 10, wherein the pilot includes at least one flushing medium hole extending at an angle to a longitudinal axis of the pilot.

13. The percussion bit assembly as set forth in claim 10, comprising a pin assembly disposed in an opening in the percussion bit for locking the pilot relative to the percussion bit.

14. The percussion bit assembly as set forth in claim 13, wherein the pilot comprises no rock cutting members.

15. The percussion bit assembly as set forth in claim 10, wherein the pilot includes a female threaded portion and the percussion bit includes a male threaded portion with which the female threaded portion is adapted to mate to fasten the pilot at the forward end of the bit.

16. The percussion bit assembly as set forth in claim 10, wherein the bit comprises a plurality of rock cutting members disposed thereon.

17. The percussion bit assembly as set forth in claim 10, comprising a shock absorber between the pilot and the bit and shank.

18. The percussion bit assembly as set forth in claim 10, wherein the pilot is made from different material than the bit and shank.

19. A method of enlarging a preexisting hole, comprising:

positioning a down-the-hole hammer having a percussion bit comprising a monolithic bit and shank and a monolithic pilot removably fastened directly to a forward end of the bit relative to the preexisting hole such that the pilot is disposed in the preexisting hole, the pilot including a recess with a circular opening extending into the pilot from a front end of the pilot so that at least first portion of the pilot including the recess has less mass per unit volume than a second portion of the pilot, the recess being recessed relative to the front end of the pilot over an entire diameter of the recess, the diameter of the recess opening being greater than one half of a diameter of the pilot;

contacting a percussion surface of the shank by a piston; and operating the down-the-hole hammer such that the bit of the percussion bit forms an enlarged hole while the pilot steers the bit relative to the preexisting hole.

20. The method of enlarging a preexisting hole as set forth in claim 19, comprising selecting a pilot adapted to fit in the preexisting hole with a desired clearance.

21. The method of enlarging a preexisting hole as set forth in claim 19, comprising providing a packing part on the pilot, the packing part being disposed between the pilot and walls of the preexisting hole.

22. The method of enlarging a preexisting hole as set forth in claim 19, comprising directing flushing medium forward through an interior passage through the percussion bit to a forward end of the bit and rearwardly through the enlarged hole.

23. The method of enlarging a preexisting hole as set forth in claim 22, comprising directing all flushing medium to the forward end of the bit through at least one opening in the pilot.

24. The method of enlarging a preexisting hole as set forth in claim 19, comprising removably fastening the pilot to the percussion bit by a threaded connection.

25. The method of enlarging a preexisting hole as set forth in claim 24, comprising removably fastening the pilot to the percussion bit by a pin arrangement.

26. The method of enlarging a preexisting hole as set forth in claim 19, comprising removably fastening the pilot to the percussion bit by a pin arrangement.

27. The method of enlarging a preexisting hole as set forth in claim 19, comprising enlarging the preexisting hole solely by cutting action of the bit.

* * * * *